US011114255B2

(12) United States Patent
Herreros et al.

(10) Patent No.: US 11,114,255 B2
(45) Date of Patent: Sep. 7, 2021

(54) ANTI-REBOUNDING LEVER WITHIN A SWITCHING DEVICE

(71) Applicant: Schneider Electric Industries SAS, Rueil-Malmaison (FR)

(72) Inventors: Javier Herreros, Grenoble (FR); Christian Bach, Seyssins (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 16/445,354

(22) Filed: Jun. 19, 2019

(65) Prior Publication Data

US 2020/0035424 A1 Jan. 30, 2020

(30) Foreign Application Priority Data

Jul. 30, 2018 (FR) ..... 18 57083

(51) Int. Cl.
*H01H 3/42* (2006.01)
*H01H 3/06* (2006.01)
*H01H 3/46* (2006.01)

(52) U.S. Cl.
CPC ..... *H01H 3/06* (2013.01); *H01H 3/46* (2013.01); *H01H 3/42* (2013.01)

(58) Field of Classification Search
CPC ..... H01H 1/50–71/54; H01H 71/504
See application file for complete search history.

(56) References Cited

U.S. PATENT DOCUMENTS 6,831,240 B2 * 12/2004 Bach ..... H01H 71/504 200/400
9,373,457 B2 † 6/2016 Roelandt
10,395,872 B2 * 8/2019 Seo ..... H01H 71/2409
2004/0134764 A1 7/2004 Bach et al.
(Continued)

FOREIGN PATENT DOCUMENTS

CN 202058671 U 11/2011
CN 202058671 U † 11/2011
CN 1026502898 † 6/2015
(Continued)

OTHER PUBLICATIONS

French Preliminary Search Report dated Apr. 24, 2019 in French Application 18 57083, filed Jul. 30, 2018 (with English Translation of Categories of cited documents & Written Opinion).

*Primary Examiner* — Vanessa Girardi
(74) *Attorney, Agent, or Firm* — Oblon, McClelland, Maier & Neustadt, L.L.P.

(57) ABSTRACT

An electrical switching device with separable contacts includes a switching apparatus including a fixed electrical contact and a mobile electrical contact that can be moved between a closing position and an opening position; a control lever mechanically coupled to the mobile electrical contact, the control lever being rotatable, about a first axis of rotation, between a first position and a second position; an anti-rebound lever arranged so as to move from a rest position to an opened-out position when the control lever reaches the second position. The anti-rebound lever engages a stop when it is in the opened-out position thereof and when the control lever is in the second position so as to prevent the control lever from leaving the second position.

13 Claims, 4 Drawing Sheets

(56) References Cited

U.S. PATENT DOCUMENTS

Figure 1:
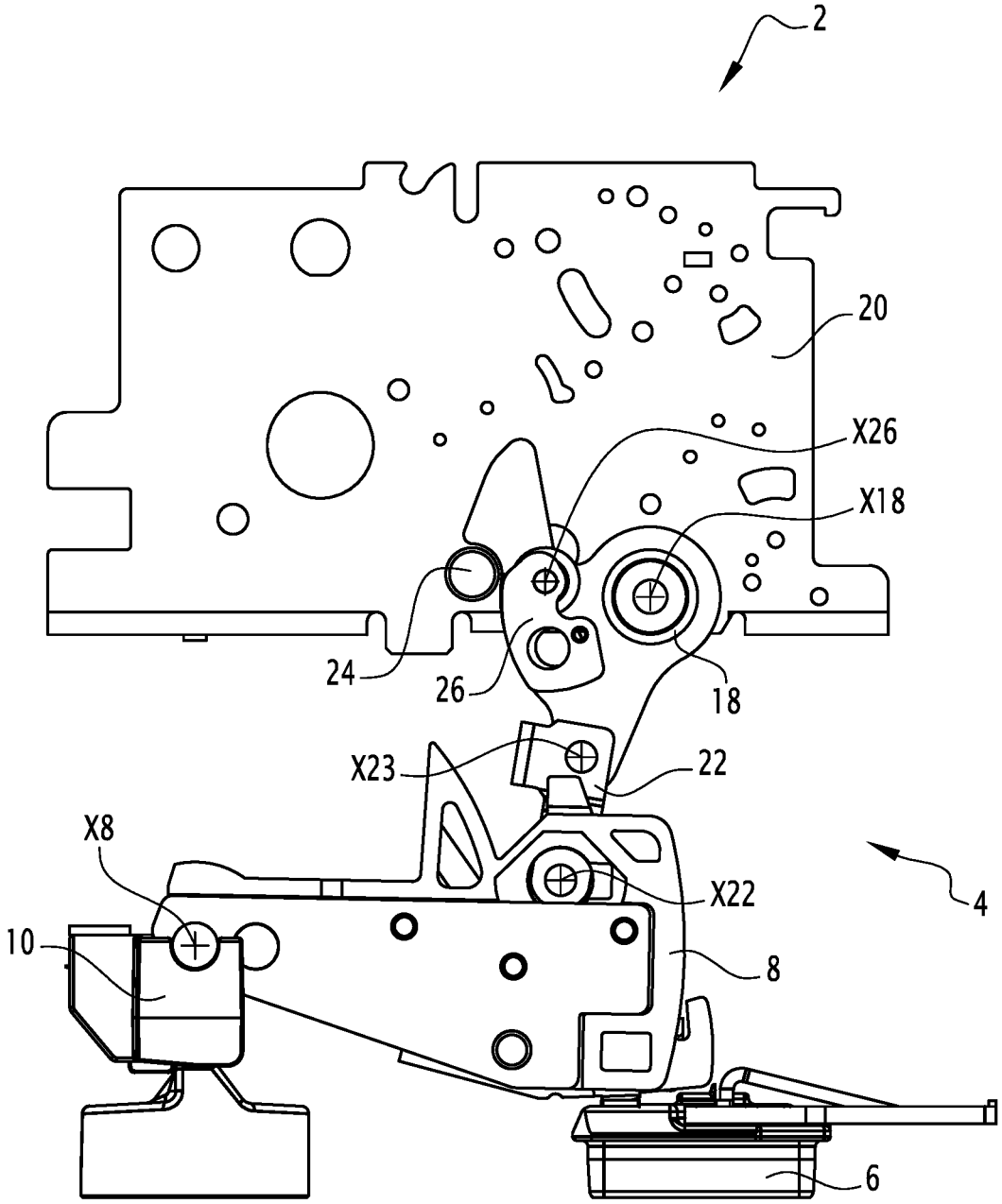

2015/0144471 A1* 5/2015 Bose ..... H01H 1/50
200/323

FOREIGN PATENT DOCUMENTS

| | | | |
|---|---|---|---|
| CN | 205752071 U | † | 11/2016 |
| CN | 205920942 U | † | 2/2017 |
| CN | 107481901 | | 12/2017 |

* cited by examiner
† cited by third party

ANTI-REBOUNDING LEVER WITHIN A SWITCHING DEVICE

The present invention relates to an electrical switching device with separable contacts.

The electrical switching devices with separable contacts, like low-voltage circuit breakers, generally include, for each pole, a fixed electrical contact and a mobile electrical contact which can be moved with respect to one another thanks to a switching mechanism in order to interrupt the flow of an electrical current. The patent EP-2 801 099-B1 describes an example of a switching device.

A disadvantage of known switching devices is that, when the switching mechanism is actuated to separate the fixed and mobile contacts in order to interrupt the flow of the current, the mobile contact can close up again accidentally once it has arrived at the end of opening travel, for example due to an uncontrolled rebound of one or more mobile pieces of the switching mechanism.

If the contacts accidentally close up again, the electrical current can flow again, whereas the device is supposed to be in an open state. Such a situation must be avoided for safety reasons.

It is this disadvantage that the invention more particularly aims to overcome by proposing an electrical switching device with separable contacts, in which device the risk of accidental closure of the electrical contacts is reduced.

To this end, the invention relates to an electrical switching device with separable contacts, comprising a switching apparatus including:

a fixed electrical contact and a mobile electrical contact that can be moved between a closing position and an opening position;

a control lever mechanically coupled to the mobile electrical contact, the control lever being rotatable, about a first axis of rotation, between a first position and a second position, the movement of the control lever from the first position to the second position causing a movement of the mobile contact from the closing position to the opening position;

an anti-rebound lever, that is mounted on the control lever by a pivoting link and can be rotated, thanks to the pivoting link, about a second axis of rotation parallel to the first axis of rotation, between a rest position and an opened-out position.

The anti-rebound lever is arranged so as to move from the rest position to the opened-out position when the control lever reaches the second position and the anti-rebound lever is arranged to engage a stop of the switching apparatus when the anti-rebound lever is in the opened-out position thereof and when the control lever is in the second position so as to prevent the control lever from leaving the second position.

Thanks to the positioning of the centre of gravity, when the control lever comes to be stopped in the second position thereof during a movement aiming to open the mobile contact, the angular momentum of the control lever is at least partially transmitted to the anti-rebound lever, which then moves to the opened-out position thereof. Once opened out, the anti-rebound lever prevents the control lever from leaving the second position thereof, even if the control lever rebounds against the stop. Thus, the risk of accidental closure of the mobile contact is controlled. The operation of the device is therefore more reliable.

According to advantageous but non-compulsory aspects of the invention, such a switching device can incorporate one or more of the following features, taken separately or in any technically permissible combination:

the centre of gravity of the anti-rebound lever is offset with respect to the pivoting link toward the outside of the control lever with respect to the path taken by the pivoting link when the control lever moves to the second position thereof from the first position;

the centre of gravity is aligned with a first straight line passing through the first axis of rotation and being perpendicular to a second coplanar straight line passing through the pivoting link, the centre of gravity being offset toward the outside of the control lever with respect to the second straight line;

the anti-rebound lever extends substantially in a geometric plane perpendicular to the first and second axes of rotation;

the anti-rebound lever includes one or more cavities;

the anti-rebound lever includes a first lobe and a second lobe which are interlinked by a central part, the pivoting link between the anti-rebound lever and the control lever being formed in one of the lobes of the anti-rebound lever;

the control lever includes a first arm on which is formed the pivoting link to the anti-rebound lever and a second arm on which is formed another pivoting link to a connection piece joined to the mobile contact to provide coupling between the control lever and the mobile contact, the first arm and the second arm being perpendicular to the first axis of rotation and being rigidly connected to a control shaft of the device extending along the first axis of rotation;

the stop is arranged to limit the travel motion of the control lever between the first position and the second position;

the stop is in contact with the second arm when the control lever is in the second position and in contact with the first arm when the control lever is in the first position;

the device is a multipolar device including one or more additional switching apparatuses similar to the switching apparatus, the device also including a control shaft common to the switching apparatuses in order to simultaneously control the movement of the respective control levers of the switching apparatuses.

Figure 2:
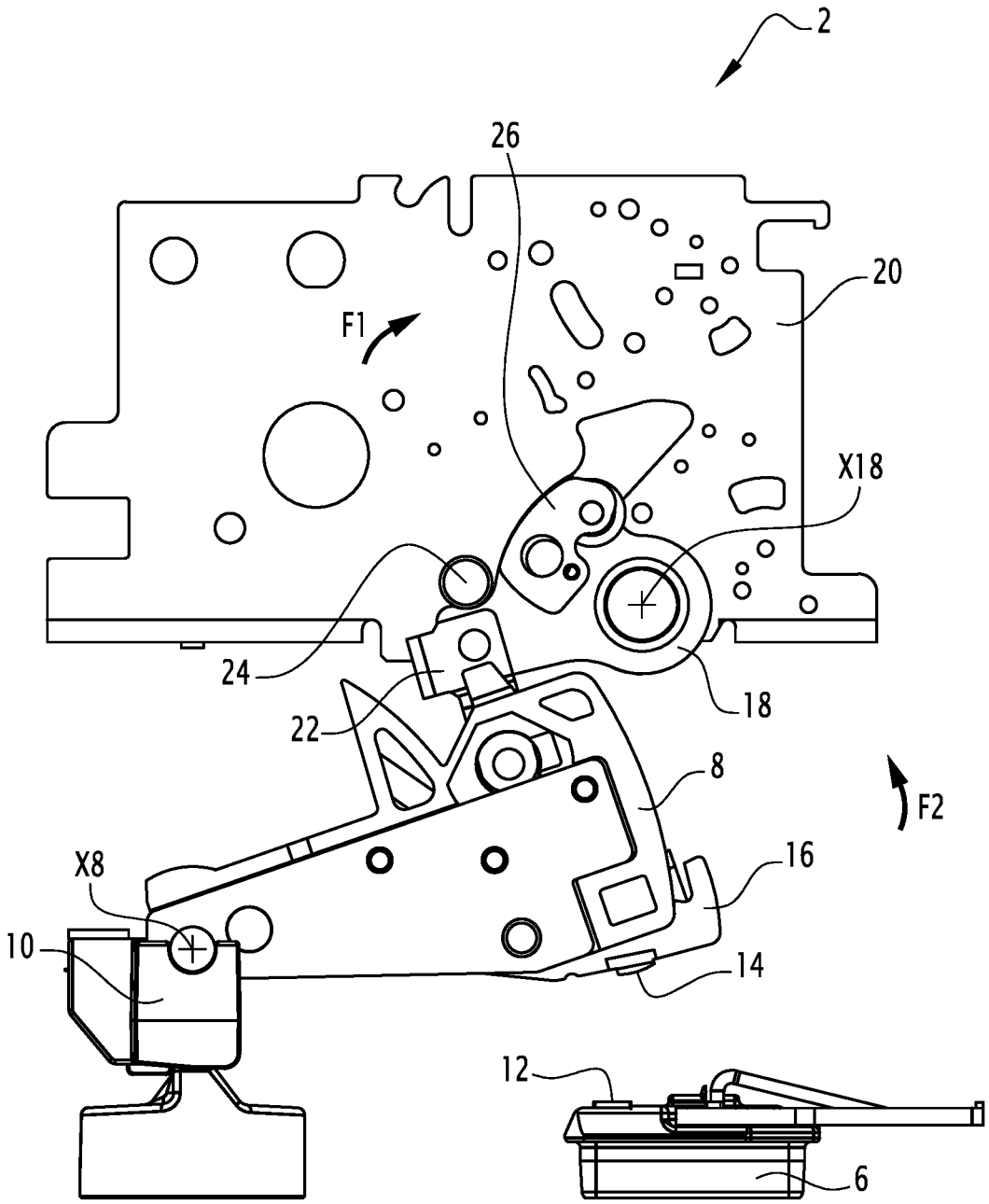
Figure 3:
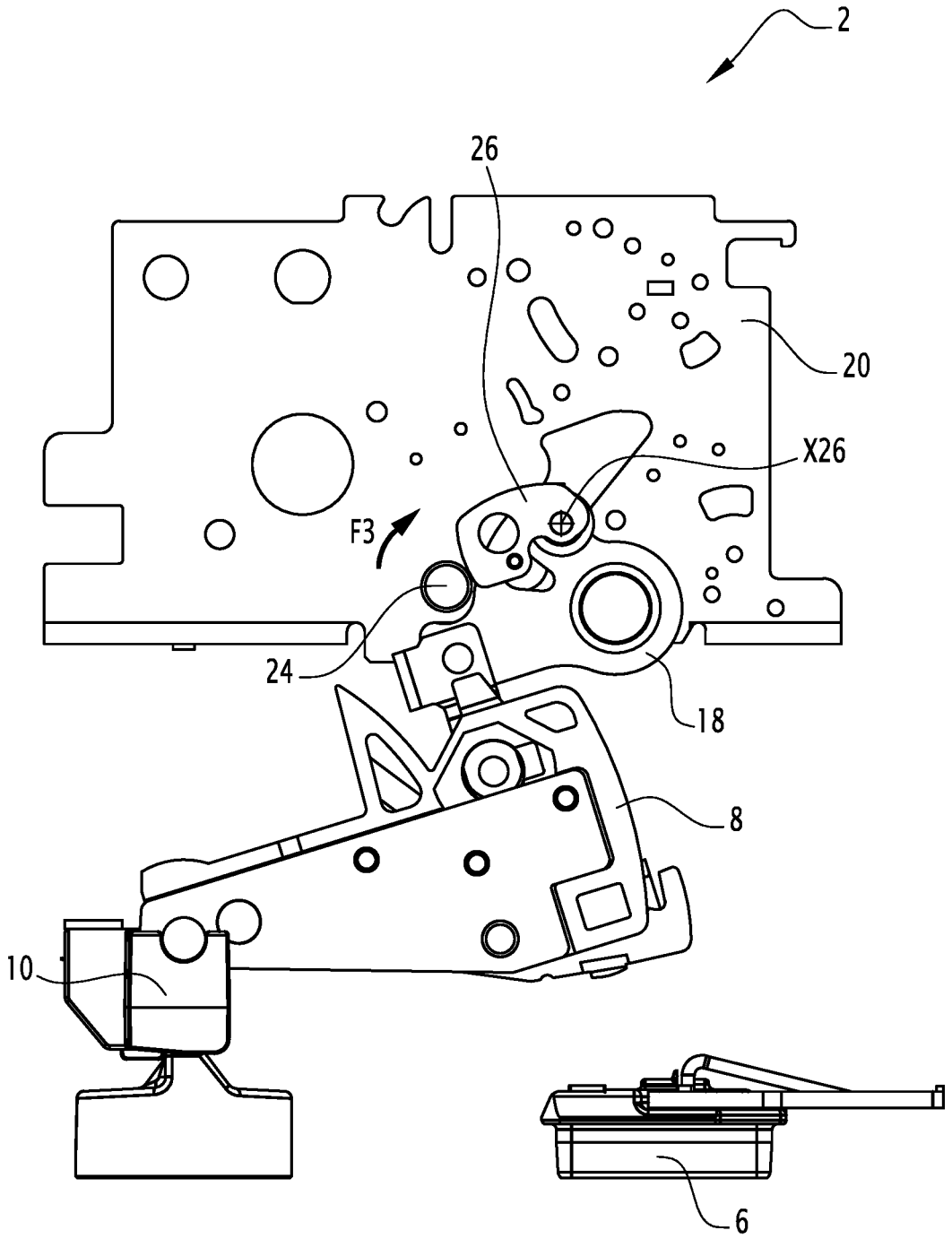
Figure 4:
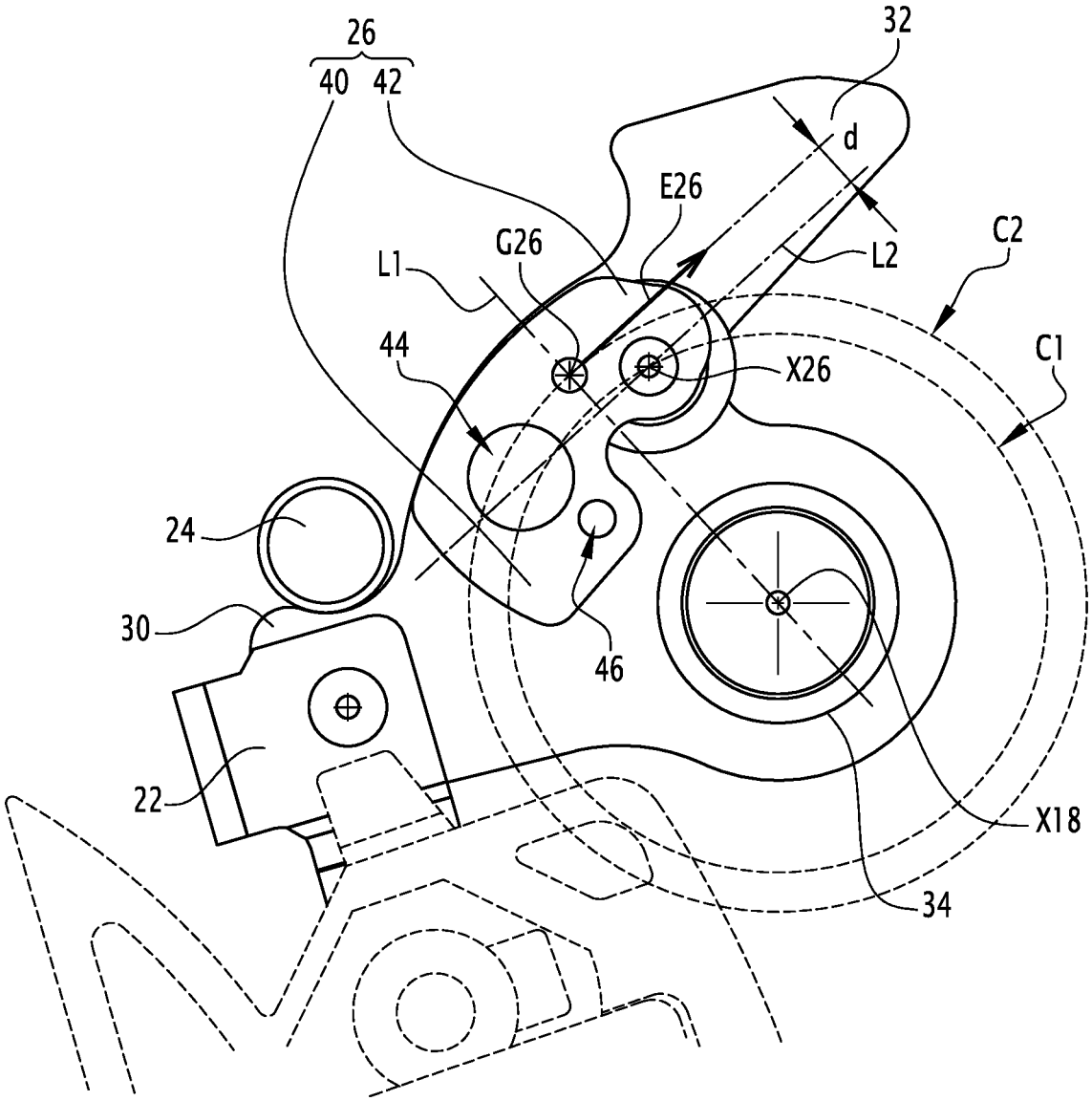

The invention will be better understood and other advantages thereof will emerge more clearly when reading the following description of an embodiment of a switching device given solely by way of example and with reference to the appended drawings, wherein:

FIG. 1 schematically shows a sectional view of an electrical switching device according to embodiments of the invention, wherein the separable contacts are closed;

FIG. 2 schematically shows the device of FIG. 1, wherein the separable contacts are open;

FIG. 3 schematically shows the device of FIG. 1, wherein the separable contacts are open and wherein an anti-rebound lever is moved into the opened-out position thereof;

FIG. 4 schematically shows an enlargement of FIG. 2.

FIGS. 1 to 4 show an electrical switching device 2, such as a contactor, or a circuit breaker, or a relay, for example intended to be connected to a power distribution facility.

The device 2 includes a switching apparatus 4 with separable contacts and a switching mechanism coupled to the separable contacts of the apparatus 4 in order to switch between open and closed states, for example in response to a trip order sent from a tripping device or from a control unit.

In this example, only one pole of the device 2 is described. However, according to modes of implementation, the device 2 is a multipolar device and includes several poles, each including an apparatus 4 similar to that described. In this case, the description of the apparatus 4 can be transposed onto the other poles of the device 2.

For example, the device 2 includes three or four poles in order to be connected to a three-phase facility. In other cases, the device 2 can include a single pole.

The apparatus 4 includes a fixed electrical contact 6 and a mobile electrical contact 8, which are connected to respective connection terminals of the device 2.

The mobile contact 8 can be moved between a closing position and an opening position with respect to the fixed contact 6 in order to permit and prevent, respectively, the flow of an electrical current between the contacts 6 and 8.

For example, the mobile contact 8 is pivotably mounted with respect to a fixed support 10 of the apparatus 4 and moves between the opening and closing positions by rotating around an axis of rotation X8.

The mobile contact 8 is illustrated in the closing position in FIG. 1 and in the opening position in FIGS. 2 and 3.

According to examples, as illustrated in FIG. 2, the apparatus 4 includes electrically conductive contact pads 12 and 14 mounted on the fixed contact 6 and the mobile contact 8, respectively.

For example, the mobile contact 8 comprises one or more contact fingers 16 pivotably mounted with respect to the contact 8, each contact finger 16 carrying one of the contact pads 14.

The apparatus 4 further includes a command lever 18 mechanically coupled to the mobile electrical contact 8.

The control lever 18 is rotatable around an axis of rotation X18 parallel to the axis X8, between a first position and a second position.

The control lever 18 is in the first position in FIG. 1 and in the second position in FIGS. 2, 3 and 4.

For example, the movement of the control lever 18 from the first position to the second position leads to a movement of the mobile contact 8 from the closing position to the opening position thereof.

Conversely, the movement of the control lever 18 from the second position to the first position leads to a movement of the mobile contact 8 from the opening position to the closing position thereof.

In the illustrated example, the control lever 18 is mobile with respect to a frame 20 of the device 2. The control lever 18 is mechanically coupled to the mobile contact 8 by means of a connection piece 22, in this case having a rectilinear shape.

According to examples, the connection piece 22 is pivotably mounted with respect to the mobile contact 8 by a first pivoting link with an axis of rotation X22 and is also pivotably mounted with respect to the control lever 18 by a second pivoting link with an axis X23. The axes X22 and X23 are parallel.

Other layouts can be used in order to mechanically couple the control lever 18 to the mobile contact 8.

The apparatus 4 also comprises a fixed stop 24, for example fixedly mounted on the frame 20 and the role of which is explained below. For example, the stop 24 includes a rigid protuberance or rod projecting with respect to the frame 20 by extending parallel to the axis X18.

The apparatus 4 also includes an anti-rebound lever 26, mounted on the control lever 18 via a pivoting link. The anti-rebound lever 26 can rotate, with respect to the control lever 18, thanks to the pivoting link, about an axis of rotation X26, between a rest position, also called a retracted position, and an opened-out position.

The axis X26 is integral with the control lever 18 and is parallel to the axis X18. In other words, the axis X26 and the corresponding pivoting link move with the control lever 18.

In the rest position, the anti-rebound lever 26 does not hinder the movement of the control lever 18. For example, the anti-rebound lever 26 is then folded onto a body of the control lever 18.

The anti-rebound lever 26 is arranged to engage the stop 24 when the anti-rebound lever is in the opened-out position thereof and when the control lever 18 is in the second position, such as to prevent the control lever 18 from leaving the second position.

The anti-rebound lever 26 is furthermore arranged to move from the rest position thereof to the opened-out position thereof when the control lever 18 reaches the second position at the end of a movement from the first position.

For this purpose, the apparatus 4 is arranged such that the control lever 18 transmits at least some of the angular momentum thereof to the anti-rebound lever 26 when the control lever 18 arrives at the end of travel in the second position, for example when it strikes the stop 24. Thus, the anti-rebound lever 26 is opened out in an automatic and quick manner.

An example of the anti-rebound lever 26 is described in greater detail with reference to FIG. 4.

The reference C1 designates a circle which is superimposed on the path taken by the pivoting link with an axis X26 between the anti-rebound lever 26 and the control lever 18 when the control lever 18 moves between the first position thereof and the second position thereof.

The reference C2 designates a circle which is superimposed on the path taken by the centre of gravity G26 of the anti-rebound lever 26 when the control lever 18 moves between the first position thereof and the second position thereof and the anti-rebound lever 26 remains in the rest position.

The paths associated with the circles C1 and C2 both have a circular arc shape. The circles C1 and C2 are concentric and coplanar.

According to embodiments, the centre of gravity G26 of the anti-rebound lever 26 is offset, with respect to the pivoting link with an axis X26, toward the outside of the control lever 18.

More precisely, the centre of gravity G26 is offset toward the outside of the control lever 18 with respect to the path taken by the pivoting link with an axis X26, this path being associated with the circle C1.

In other words, the centre of gravity G26 is located outside the circle C1. The radius of the circle C2 is strictly greater than the radius of the circle C1.

The outside of the control lever 18 in this case is defined with respect to the axis X18. For example, an element described as being "toward the outside" of the command lever 18 is further from the axis X18 than an element which would be described as being placed "toward the inside" of the control lever 18.

For example, the stop 24 is located outside the control lever 18.

In the illustrated example, the centre of gravity G26 is aligned with a first straight line L1 passing through the axis X18 and being perpendicular to a second coplanar straight line L2 passing through the pivoting link with an axis X26. The centre of gravity G26 is offset toward the outside of the control lever 18 with respect to the second straight line L2.

For example, the distance "d" between the second straight line L2 and the centre of gravity G26, as measured in parallel with the first straight line L1, is not zero, for example greater than or equal to 5% of the radius of the circle C1.

Preferably, the distance "d2", not illustrated, between the centre of gravity G26 and the path C1, as measured along the straight line L1, is not zero, for example greater than or equal to 5% of the radius of the circle C1. The distance d2 corresponds to the difference between the radii of the circles C2 and C1.

According to modes of implementation, the anti-rebound lever 26 extends substantially in a geometric plane perpendicular to the axes X18 and X26. For example, the anti-rebound lever 26 is flat. In an alternative, the anti-rebound lever 26 can have other forms that are not necessarily flat, such as for example the form of a rod coupled with a weight.

In the illustrated example, the anti-rebound lever 26 has a flat and rounded shape and includes a first lobe 40 and a second lobe 42 interconnected by a central part.

The pivoting link with an axis X26 between the anti-rebound lever 26 and the control lever 18 is, for example, formed in one of the lobes of the anti-rebound lever 26, in this case in the second lobe 42.

Advantageously, the anti-rebound lever 26 includes one or more cavities 44, 46. The cavities make it possible, when manufacturing the anti-rebound lever 26, to precisely choose the location of the centre of gravity G26.

There are two illustrated lobes 40, 42 in this case and each has a circular shape and different sizes. In an alternative, a different number of lobes 40, 42 can be chosen, and the same applies to the shape thereof and/or the dimension thereof and/or the location thereof, depending on the intended site for the centre of gravity G26.

According to embodiments, the anti-rebound lever 26 is produced from metal material, or from a polymer material, like a thermosetting plastic material.

As a purely illustrative and not necessarily limiting example, the anti-rebound lever 26 weighs between 10 g and 30 g inclusive, for example 12 g.

According to modes of implementation, the control lever 18 is part of a control shaft, also called a pole shaft, which is aligned with the axis X18 and can turn around the axis X18. The control shaft is, for example, coupled to the trip mechanism of the apparatus 2.

The control lever 18 is constrained to rotate with the shaft about the axis X18.

For example, the control lever 18 is formed by one or more cams of the control shaft.

In the illustrated example, the control lever 18 includes two arms 30 and 32 perpendicular to the axis X18 and rigidly connected to a control shaft 34. The arms 30 and 32 project from the shaft 34 toward the outside of the shaft 34.

The arms 30 and 32 in this case have a substantially planar shape and extend in the same geometric plane as the anti-rebound lever 26. In other words, the anti-rebound lever 26 and the arms 30, 32 each have a planar shape and are parallel to one another.

According to the examples, the stop 24 limits the movement of the control lever 18 between the first position and the second position by coming into contact with the arms 30 and 32 such as to block the rotation of the shaft 34.

More precisely, the stop 24 in this case is in contact with the arm 30 when the control lever 18 is in the second position, in order to prevent the control lever 18 from continuing the movement thereof beyond the second position. The stop 24 is in contact with the arm 32 when the control lever 18 is in the first position, in order to prevent the control lever 18 from turning, in the opposite direction, beyond the first position. In an alternative, in the first position, the edge of the arm 32 can be extremely close to the stop 24 without actually being directly in contact with the stop 24.

Thus, in this example, the stop 24 is arranged to limit the travel motion of the control lever 18 both between the first position and the second position.

In the described examples, when the control lever 18 is in the second position and the anti-rebound lever 26 is opened-out, the arm 30 and the anti-rebound lever 26 are located on either side of the stop 24, in immediate proximity to the stop 24, or even in direct contact with the stop 24. Thus, the movement of the control lever 18 (and therefore of the shaft 34) is made impossible while the anti-rebound lever 26 remains in the opened-out position thereof.

In practice, the arm 30 and the anti-rebound lever 26 are not necessarily constantly both in direct contact with the stop 24, such that a small travel motion in proximity to the second position can be permitted in such an instance for the control lever 18.

According to modes of implementation, the pivoting link linking the piece 22 to the control lever 18 is mounted on the arm 30. The pivoting link linking the control lever 18 to the anti-rebound lever 26 is mounted on the arm 32.

The arms 30 and 32 in this case are linked by a rounded portion in the shape of a circular arc centred on the axis X18. In the folded position, the anti-rebound lever 26 overlaps the rounded portion and the upper edge of the anti-rebound lever 26 is aligned with the outer edge of the rounded portion. The anti-rebound lever 26 does not then jut out from the rounded portion, such as to not hinder the movement of the control lever 18 and of the shaft 34.

According to alternatives, when the device 2 includes several poles, the control shaft is preferably common to the switching apparatuses 4 of the various poles such as to be able to simultaneously control the movement of the respective control levers 18 of these apparatuses 4.

For example, each pole of the device 2 is associated with a dedicated compartment in a casing of the device 2. The compartments are aligned side-by-side along the axis X18. The control shaft passes through the lateral walls separating two adjacent compartments via dedicated through-holes.

An example of the operation of the apparatus 4 is now described with reference to FIGS. 1 to 3.

Initially, the apparatus 4 is in the closed state, as illustrated in FIG. 1. The conductive parts of the contacts 6 and 8 touch one another and the electrical current can flow.

The control lever 18 is in the first position. For example, an edge of the arm 32 is in contact with the stop 24, or extremely close to the stop 24, for example at a distance of less than five millimetres from the stop 24. The anti-rebound lever 26 is in the rest position.

Then, the switching mechanism is tripped to open the apparatus 4, i.e. to separate the contacts 6 and 8 and to interrupt the current.

For this purpose, the control lever 18 is rotated around the axis X18, for example by turning the shaft 34 in a first rotation direction, illustrated by the arrow F1 in FIG. 2. This movement is transmitted by the piece 22 to the mobile contact 8 which then turns around the axis X8 in a second rotation direction, illustrated by the arrow F2. At this stage, the anti-rebound lever 26 remains in the rest position.

The rotation movement of the control lever 18 continues until the command lever 18 reaches the second position, i.e. it arrives at the end of travel, corresponding in this case to the position in which the arm 30 comes into contact with the stop 24, as is illustrated in FIG. 2.

In practice, when the control lever 18 arrives in the second position thereof at the end of travel, it can, due to the speed thereof, rebound and then move in the opposite direction toward the first position thereof.

In the illustrated example, the arm 30 strikes the stop 24 when it arrives at the end of travel. In FIG. 3, the control lever 18 has, moreover, started to leave the second position and the arm 30 has started to move away slightly from the stop 24.

However, the anti-return lever 26 has moved in the meantime into the opened-out position, in contact against the stop 24, and this prevents the control lever 18 from continuing to move away from the second position.

Indeed, thanks to the positioning of the centre of gravity G26 of the anti-rebound lever 26, when the control lever 18 comes to be stopped in the second position thereof, the angular momentum of the control lever 18 is at least partially transmitted to the anti-rebound lever 26, for example when the control lever 18 collides with the stop 24. The anti-rebound lever 26 then moves to the opened-out position thereof.

For example, when the control lever 18 arrives at the end of travel, a moment proportional to the distance d is applied to the centre of gravity G26 of the anti-rebound lever 26, as is illustrated by the arrow E26 in FIG. 4.

Once opened-out, the anti-rebound lever 26 prevents the control lever 18 from leaving the second position thereof, by engaging the stop 24, even if the control lever 18 rebounds against the stop and has started to move away therefrom, as is the case here. The control lever 18 then remains in proximity to the second position. The contact 8 cannot therefore close up accidentally.

Thus, the risk of accidental closure of the mobile contact 8 is reduced. The operation of the device 2 is therefore more reliable.

In particular, the movement of the anti-rebound lever 26 does not depend on the speed of rotation of the control lever 18. The risk of the contact 8 reopening is therefore reduced, independently of the circumstances in which tripping occurs, even when the control lever 18 moves slowly.

Furthermore, the anti-rebound lever 26 can be integrated during the construction of the device 2 without it being necessary to completely modify the architecture of the apparatus 4.

In practice, the anti-rebound lever 26 can then be brought back to the rest position thereof, for example once the control lever 18 has stopped in the second position. The return to the rest position can be achieved manually or via gravity or via an elastic return device such as a spring linked to the anti-rebound lever 26.

The embodiments and the alternatives envisaged above can be combined with one another in order to produce new embodiments.

The invention claimed is:

1. An electrical switching device with separable contacts, comprising a switching apparatus including:

a fixed electrical contact and a mobile electrical contact that can be moved between a closing position and an opening position;

a control lever mechanically coupled to the mobile electrical contact, the control lever being rotatable, about a first axis of rotation, between a first position and a second position, the movement of the control lever from the first position to the second position causing a movement of the mobile contact from the closing position to the opening position; and an anti-rebound lever, that is mounted on the control lever by a pivoting link and can be rotated about a second axis that is an axis of the pivoting link and that is parallel to the first axis of rotation, between a rest position and an opened-out position, wherein the anti-rebound lever is configured to move from the rest position to the opened-out position when the control lever reaches the second position, the anti-rebound lever is configured to engage a stop of the switching apparatus with a convex edge thereof when the anti-rebound lever is in the opened-out position thereof and when the control lever is in the second position to prevent the control lever from leaving the second position, and the anti-rebound lever includes a first lobe and a second lobe, and the anti-rebound lever is formed to have a center of gravity located in a smaller of the first lobe and the second lobe.

2. The device according to claim 1, wherein said anti-rebound lever extends substantially in a geometric plane perpendicular to the first and second axes of rotation.

3. The device according to claim 1, wherein said anti-rebound lever includes one or more cavities in order to define a location of the center of gravity.

4. The device according to claim 1, wherein said stop is arranged to limit a travel motion of the control lever between the first position and the second position.

5. The device according to claim 1, wherein said device is a multipolar device.

6. The device according to claim 1, wherein the center of gravity of the anti-rebound lever is offset, with respect to the pivoting link, toward an outside of the control lever with respect to a path taken by the pivoting link when the control lever moves to the second position thereof from the first position.

7. The device according to claim 6, wherein said center of gravity is aligned with a first straight line passing through the first axis of rotation and being perpendicular to a second coplanar straight line passing through the pivoting link, the center of gravity being offset toward the outside of the control lever with respect to the second straight line.

8. The device according to claim 1, wherein said control lever includes a first arm on which is formed the pivoting link to the anti-rebound lever and a second arm on which is formed another pivoting link to a connection piece joined to the mobile contact to provide coupling between the control lever and the mobile contact, the first arm and the second arm being perpendicular to the first axis of rotation and being rigidly connected to a control shaft of the device extending along the first axis of rotation.

9. The device according to claim 8, wherein said stop is in contact with the second arm when the control lever is in the second position and in contact with the first arm when the control lever is in the first position.

10. The device according to claim 1, wherein the first lobe and the second lobe of the anti-rebound lever are interlinked by a central part, the pivoting link between the anti-rebound lever and the control lever being formed in one of the first and second lobes of the anti-rebound lever.

11. The device according to claim 10, wherein the first lobe and the second lobe have different dimensions.

12. The device according to claim 10, wherein the convex edge of the anti-rebound lever which engages the stop of the switching apparatus is disposed on a larger of the first lobe and the second lobe.

13. The device according to claim 10, wherein the pivoting link between the anti-rebound lever and the control lever is formed in a smaller of the first lobe and the second lobe.

* * * * *